US006575390B2

(12) United States Patent
Kamikawa et al.

(10) Patent No.: US 6,575,390 B2
(45) Date of Patent: Jun. 10, 2003

(54) PRETREATMENT APPARATUS FOR RAW MATERIALS FOR PRODUCTION OF REDUCED IRON

(75) Inventors: Susumu Kamikawa, Hiroshima (JP); Hironori Fujioka, Hiroshima (JP); Hiromi Osaka, Hiroshima (JP); Keiichi Sato, Hiroshima (JP); Yoshimitsu Onaka, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/828,818

(22) Filed: Apr. 10, 2001

(65) Prior Publication Data

US 2002/0005444 A1 Jan. 17, 2002

(30) Foreign Application Priority Data

Jul. 11, 2000 (JP) ..... 2000-209515

(51) Int. Cl.[7] ..... B02O 23/18; B02C 23/18; B02C 23/20

(52) U.S. Cl. ..... 241/43; 241/44; 241/65; 241/79

(58) Field of Search ..... 241/17, 24.24, 241/43, 44, 65, 78, 79

(56) References Cited

U.S. PATENT DOCUMENTS 3,806,046 A * 4/1974 Kouloheris et al. ..... 241/19
4,461,428 A * 7/1984 Williams ..... 241/34

* cited by examiner

*Primary Examiner*—John M. Husar
(74) *Attorney, Agent, or Firm*—Birch, Stewart, Kolasch & Birch, LLP

(57) ABSTRACT

A pretreatment apparatus for raw materials for production of reduced iron pretreats the raw materials, comprising an iron material, such as iron ore, and other raw materials, such as coal and flux, by a dryer, classifiers, a roll press, and a vertical mill, and feeds the pretreated raw materials to a pelletizer via a feed bin. At least two fluidized mixers for mixing the classified raw materials, one of the fluidized mixers for storage and the other fluidized mixer for supply, are provided for batch treatment. The pretreatment apparatus can uniformize the crushed particle sizes of iron ore, coal, etc. different in hardness, stably supply homogeneously mixed raw materials, and simplify pelletization-side facilities.

6 Claims, 7 Drawing Sheets

PRETREATMENT APPARATUS FOR RAW MATERIALS FOR PRODUCTION OF REDUCED IRON

BACKGROUND OF THE INVENTION

1. Field of the Invention

The present invention relates to a pretreatment apparatus for raw materials for production of reduced iron.

2. Description of the Related Art

Generally, in producing reduced iron, the first step is to mix a powder of iron ore (iron oxide), a powder of coal (reducing agent), a powder of limestone (fluxing agent), and a binder such as bentonite, and compress and pelletize the mixture to form wet balls called green balls. Then, the wet balls are dried to some degree to form dry balls. The dry balls are heated to a high temperature in a reducing furnace, where iron oxide in the iron ore is reduced with the coal, as a reducing agent, to form reduced iron in pellet form.

Before the above-described compression and pelletization of various raw materials for production of reduced iron, pretreatment, for example, as shown in FIGS. 6 and 7 has been performed so far. FIG. 6 is a concept view of a conventional apparatus for pretreatment of raw materials for production of reduced iron. According to this apparatus, iron ore, coal, and flux, which are raw materials for production of reduced iron, are treated in the following manner: These materials are supplied in parallel from individual silos 51, 52, 53 to a single crusher 54 for mixing and crushing, and classified by a classifier 55. These steps are repeated to crush the raw materials into fine particles. The so finely crushed, mixed raw materials are further mixed in a mixer 57, stored in a feed bin 58, and fed from the feed bin 58 to a pelletizer 59 for production of raw pellets (pelletization). The raw pellets produced in the pelletizer 59 are dried in a dryer 61, and then carried and fed into a reducing furnace 63. FIG. 7 shows an equipment configuration ranging from the mixer 57 to the pelletizer 59 in FIG. 6. According to this configuration, powders of the raw materials mixed in the mixer 57 are stored and fed, for example, as follows: Total 16 of the feed bins 58 are provided for 8 of the pelletizers 59 at a rate of the two feed bins 58 perpelletizer 59 (one of the feed bins 58 for storage, and the other feed bin 58 for feed to the pelletizer 59). Storage and feed alternate such that the raw material powders are fed from two dedicated feed bins 58 to one pelletizer 59.

In performing mixing in the mixer 57, the hydrophilic iron ore and flux, and the hydrophobic coal, namely, the raw materials different in specific gravity and hardness, are mixed. As the mixer 57, a two-screw mixer has hitherto been used. This type of mixer is unsuitable for mixing the above-mentioned raw materials different in specific gravity and hardness, and it is difficult for such a mixer to feed homogeneously mixed raw materials stably to the pelletizer 59. To obtain a homogeneous mixture of the raw materials by use of the two-screw mixer, the screw shaft has to be fully long, or the rotational speed of the screws has to be fully increased. This results in a hike in the equipment cost or an increase in energy (power) consumption.

Furthermore, the iron ore is crushed, together with the coal and the flux, by means of the single crusher, regardless of the particle size of the iron ore. Thus, the type of mill is selected so as to be suitable for iron ore with high hardness. As a result, if the particle size of the iron ore is small, the crusher has overcapacity and is costly. Besides, the amount of the feed to the pelletization facilities is unstable, because it is easily affected by the particle size distribution of the raw materials before crushing. As shown in FIG. 7, therefore, the plural feed bins 58 have to be provided per pelletizer 59 in order to ensure an adequate amount of feed of the crushed raw materials to the pelletizer 59. This requirement further increases the equipment cost. equipment cost.

SUMMARY OF THE INVENTION

The present invention has been proposed in light of the foregoing problems with the conventional pretreatment of raw materials for production of reduced iron. It is an object of this invention to provide a pretreatment apparatus which can uniformize the crushed particle sizes of iron ore, coal, etc. different in hardness, stably supply homogeneously mixed raw materials, and simplify pelletization-side facilities.

A first aspect of the present invention, as a means of attaining the above object, is a pretreatment apparatus for raw materials for production of reduced iron, which applies pretreatment steps, including drying, crushing, classification, and mixing, to the raw materials for production of reduced iron, the raw materials comprising an iron material, such as iron ore, and other raw materials, such as coal and flux, and feeds the pretreated raw materials to a pelletization device via a feed bin, the pretreatment apparatus including a fluidized mixer for mixing the raw materials for production of reduced iron after the classification. According to this aspect, there can be realized a pretreatment apparatus which can stably supply homogeneously mixed raw materials comprising an iron material and other raw materials different in hardness, and simplify pelletization-side facilities.

A second aspect of the invention is the pretreatment apparatus for raw materials for production of reduced iron, wherein at least two of the fluidized mixers, one of the fluidized mixers for storage and the other fluidized mixer for supply, are provided for batch treatment. According to this aspect, constant-amount supply of the mixed raw materials is facilitated to ensure stably supply.

A third aspect of the invention is the pretreatment apparatus for raw materials for production of reduced iron, wherein when the iron material such as iron ore exceeds a predetermined particle size, the iron material such as iron ore is crushed by a dedicated crusher, and the other raw materials such as coal and flux are both crushed by a separate single crusher. According to this aspect, the crushing force of the crusher for crushing the iron material such as iron ore is utilized most effectively to decrease a loss of energy. Thus, the iron ore can be crushed to a uniform particle size much more efficiently than before.

A fourth aspect of the invention is the pretreatment apparatus for raw materials for production of reduced iron, wherein the crusher for crushing the iron material such as iron ore crushes an unrecovered iron material classified by a classifier, and returns the crushed iron material to the classifier. According to this aspect, only the iron ore that truly requires crushing can be crushed efficiently by the crusher.

A fifth aspect of the invention is the pretreatment apparatus for raw materials for production of reduced iron, wherein when the iron material such as iron ore has a predetermined or smaller particle size, the iron material such as iron ore is directly supplied from a raw material silo to a crusher for the other raw materials such as coal and flux, and premixed with the other raw materials, and the fluidized mixer is provided alone for continuous treatment of the premixed raw materials. According to this aspect, the equipment cost can be markedly decreased by simplification of the equipment.

BRIEF DESCRIPTION OF THE DRAWINGS

The above and other objects, features and advantages of the present invention will become more apparent from the following description taken in connection with the accompanying drawings, in which.

DETAILED DESCRIPTION OF THE PREFERRED EMBODIMENTS

Preferred embodiments of the present invention will now be described in detail with reference to the accompanying drawings, which in no way limit the invention.

[First Embodiment]

Figure 1:
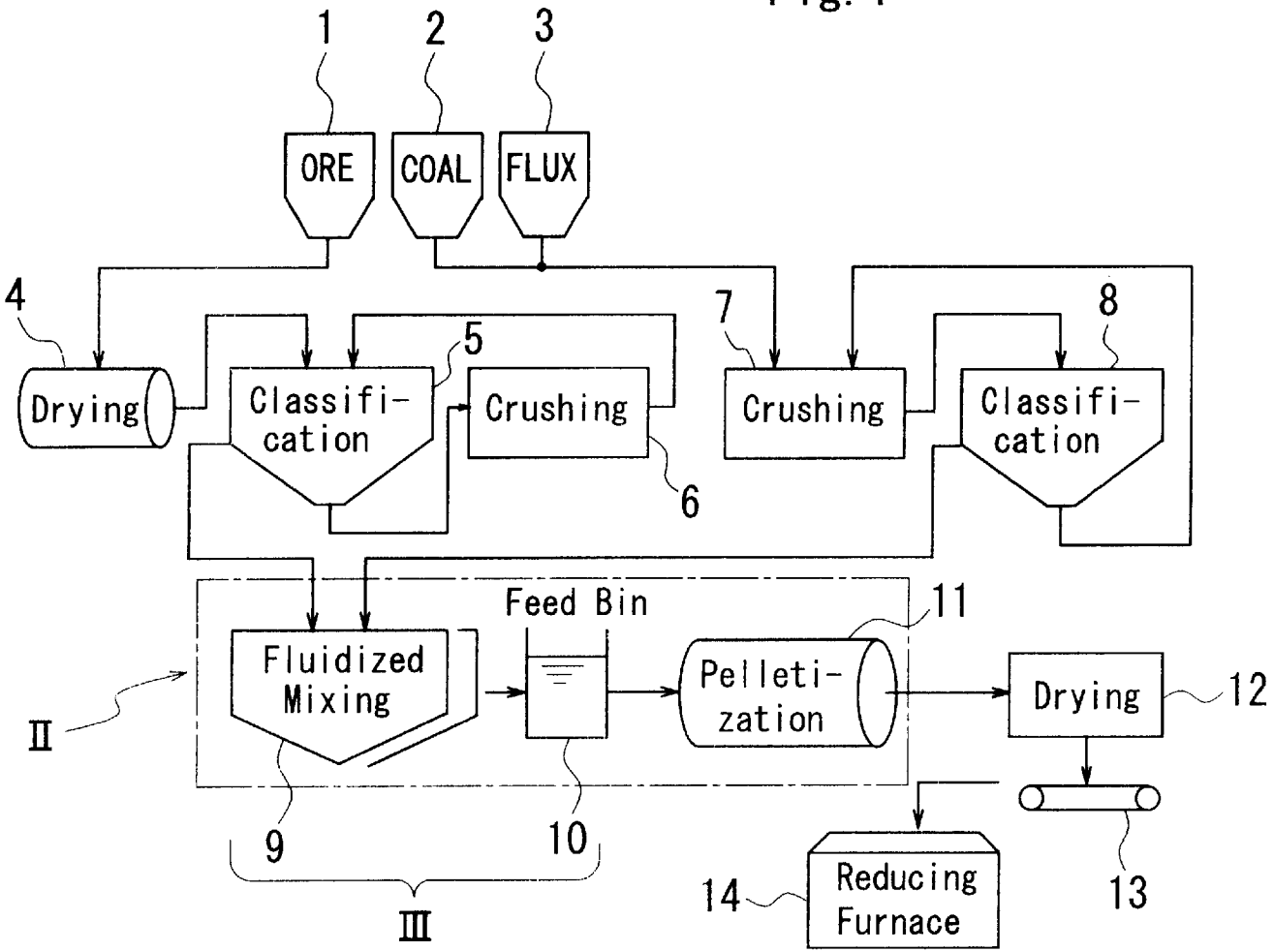
FIG. 1 is a concept view of a pretreatment apparatus for raw materials for production of reduced iron according to a first embodiment of the present invention.
Figure 2:
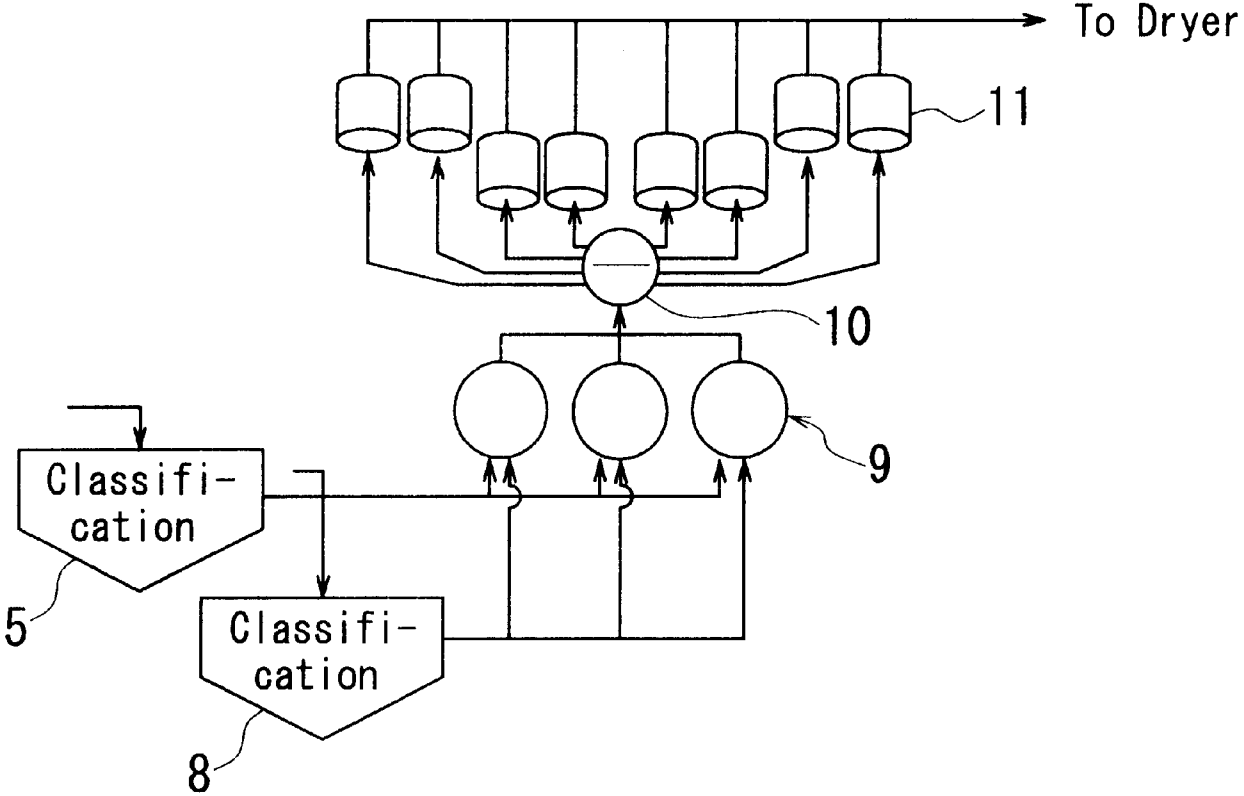
FIG. 2 is a facility configuration view of a portion II in FIG. 1.
Figure 3:
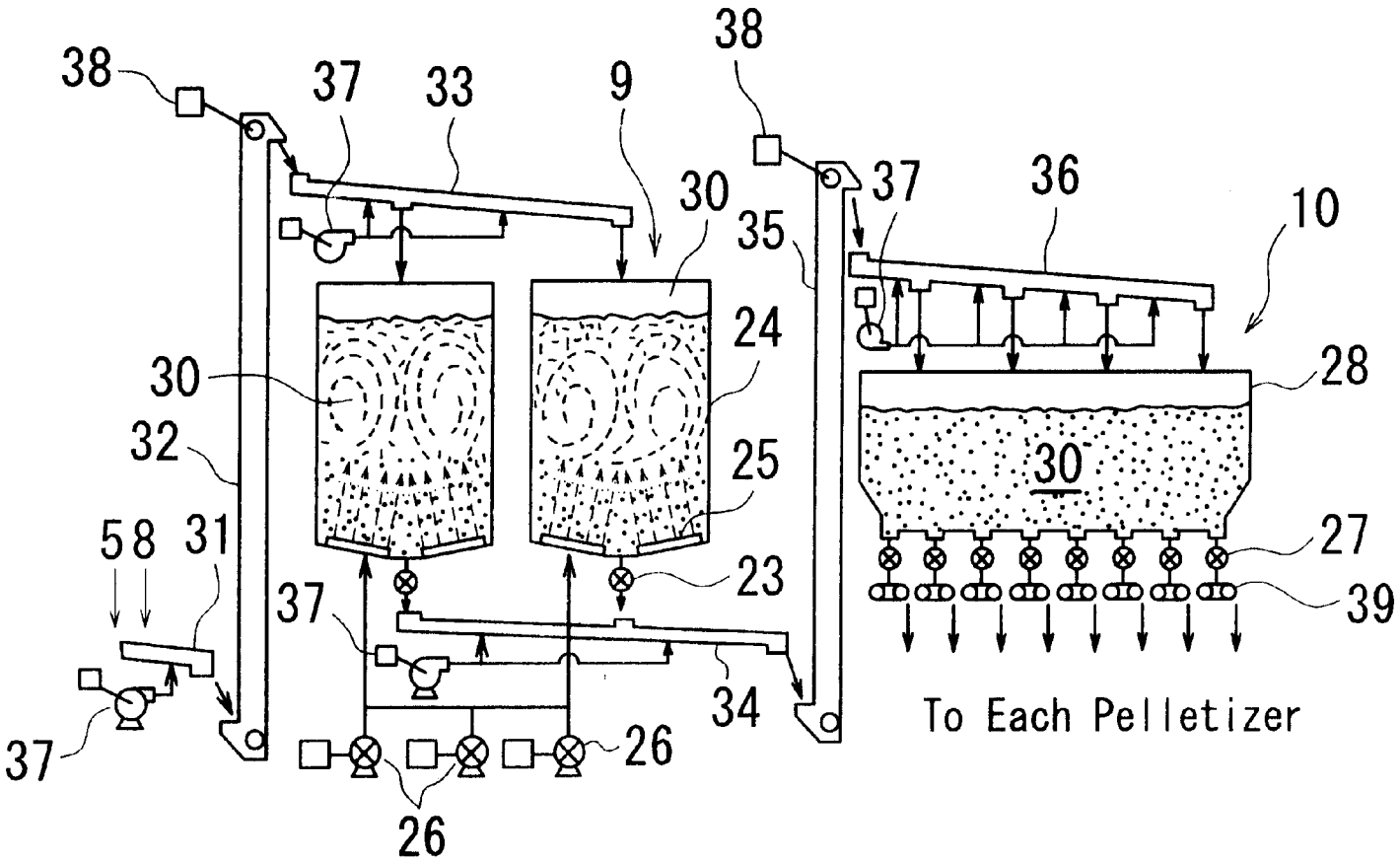
FIG. 3 is an enlarged sectional view of a portion III in FIG. 1.

FIG. 1 is a concept view of a pretreatment apparatus for raw materials for production of reduced iron according to a first embodiment of the present invention. FIG. 2 is a facility configuration view of a portion II in FIG. 1. FIG. 3 is an enlarged sectional view of a portion III in FIG. 1.

According to the present embodiment, iron ore with higher hardness, and other raw materials with lower hardness, such as coal and flux, among the raw materials for production of reduced iron, are crushed by respective crushers suitable for these raw materials different in hardness. First, the iron ore is dried by a hot air dryer or the like, classified, and then crushed. The crushed iron ore powder is further classified, while the coal and flux are also crushed and classified. The resulting iron ore powder is mixed with a powdery mixture of coal and flux in a fluidized mixer. The resulting mixture is passed through a single feed bin, and fed to a plurality of pelletizers to form raw pellets.

In FIG. 1, the numerals 1, 2, 3 denote raw material silos for iron ore, coal and flux. The numeral 4 denotes a dryer for drying iron ore supplied from the raw material silo 1. The numeral 5 denotes a classifier for classifying the iron ore dried by the dryer 4. The numeral 6 denotes a roll press for crushing of high hardness iron ore. The roll press is provided to accept iron ore of a size exceeding a prescribed particle size that has been classified by the classifier 5, crush the accepted iron ore, and return the crushed iron ore to the classifier 5. The numeral 7 denotes a vertical mill for crushing of low hardness raw materials, which is designed to crush the coal and the flux supplied from the raw material silos 2 and 3. The numeral 8 denotes a classifier provided to classify the raw materials crushed by the vertical mill 7, and return coal and flux of a size exceeding a prescribed particle size to the vertical mill 7.

The numeral 9 denotes a fluidized mixer, and the numeral 10 denotes a feed bin provided with feeders to a plurality of pelletizers. Preferably, two of the fluidized mixers 9, one for storage and the other for supply, are provided. The numeral 11 denotes a pelletizer for pelletizing the raw material powder mixture fed from the feed bin 10. The numeral 12 denotes a dryer for drying raw pellets formed by the pelletizer 11. The numeral 13 denotes a conveyor, and the numeral 14 denotes a reducing furnace.

As shown in FIG. 2, a plurality of the fluidized mixers 9 are provided at positions close to the pelletizers 11 in such a manner as to be connected to the iron ore classifier 5 and the coal/flux classifier 8. The single feed bin 10 is provided in such a manner as to be connected to the plurality of fluidized mixers 9. The single feed bin 10 is connected so as to be capable of feeding the raw materials, for example, to 8 of the pelletizers 11. The fluidized mixer 9 and the feed bin 10 are used in cement production plant, etc., and well known. FIG. 3 shows, as a continuous vertical sectional view, a configuration in which similar fluidized mixers 9 and a similar feed bin 10 are used to mix and feed powders of raw materials for production of reduced iron.

As shown in FIG. 3, the fluidized mixer 9 is composed, roughly, of a cylindrical vessel 24 having a discharge port with an opening/closing valve 23 at the bottom of the vessel 24, many air nozzles 25 provided in an inner bottom portion of the vessel 24, and a plurality of pressurized air feeders 26 for ejecting pressurized air from the air nozzles 25 into the vessel 24. In FIG. 3, two of the fluidized mixers 9 are provided.

The feed bin 10 is composed of a cylindrical vessel 28 having discharge ports arranged side by side at the bottom of the vessel 28, the discharge ports being equipped with opening/closing valves 27 corresponding in number to the number of the pelletizers 11. Powders 30 of the raw materials for production of reduced iron, which have been supplied from the classifiers 5 and 8, are supplied into the vessels 24 of the two fluidized mixers 9 via a pneumatic tube 31, a vertical conveyor 32, and a pneumatic tube 33. Mixed raw material powders 30 withdrawn from the two fluidized mixers 9 are supplied into the vessel 28 of the feed bin 10 via a pneumatic tube 34, a vertical conveyor 35, and a pneumatic tube 36. In FIG. 3, the numeral 37 denotes a feeder of pneumatic feed air to each pneumatic tube. The numeral 38 denotes a drive motor for the vertical conveyors 32, 35. The numeral 39 denotes a conveyor for supplying the raw materials from the discharge port with the opening/closing valve 27 of the large feed bin 10 to each pelletizer 11.

Because of the foregoing configuration, the iron ore of the raw materials for production of reduced iron is dried alone by the dryer 4. After the powder with a predetermined or smaller particle size is recovered by the classifier 5, the remaining iron ore is supplied to the roll press 6 for crushing of high hardness ore. The crushed iron ore is returned from the roll press 6 to the classifier 5. This procedure is repeated, whereby only the iron ore that truly requires crushing can constantly be crushed by the roll press 6 for crushing of high hardness ore. Thus, the crushing force of the roll press 6 can be utilized most effectively to decrease a loss of energy. Consequently, iron ore can be crushed to a uniform particle size much more efficiently than in the earlier technology.

Coal and flux, on the other hand, are crushed together by the vertical mill 7 for crushing of low hardness raw materials, and a powder with a prescribed or smaller particle size is recovered by the classifier 8. By repeating this procedure, the coal and flux can be crushed to a uniform particle size with high efficiency without using extensive equipment. Simultaneously, both types of the resulting powdery raw materials with uniform particle sizes, i.e., iron ore, and coal and flux, are supplied in adequate amounts from the classifiers 5 and 8 to the fluidized mixer 9. As a result, the production speed for the mixed raw materials by the fluidized mixer 9 increases, and the fixed-amount supply of the mixed powdery raw materials toward the pelletizer 11 becomes easy, stabilizing their supply. The fluidized mixer 9 releases pressurized air from the air nozzles 25 at the bottom into the iron ore, coal and flux powders 30 accepted in the vessel 24 to maintain the powders 30 in the vessel 24 in a fluidized state for a certain period of time (for example, 15 to 30 minutes). By this measure, the powders of iron ore, coal and flux different in specific gravity and hardness are mixed together uniformly and in a state free from reseparation due to sedimentation or the like. The resulting mixed powders 30 are sent into the vessel 28 of the single feed bin 10 from at least two of the fluidized mixers 9 batchwise and alternately in an adequate amount, and fed from the feed bin 10 to each pelletizer 11 via the feed conveyors 39. Hence, the raw materials for production of reduced iron can be smoothly supplied in constant amounts toward the pelletization section with the use of a minimum number of facilities.

[Second Embodiment]

Figure 4:
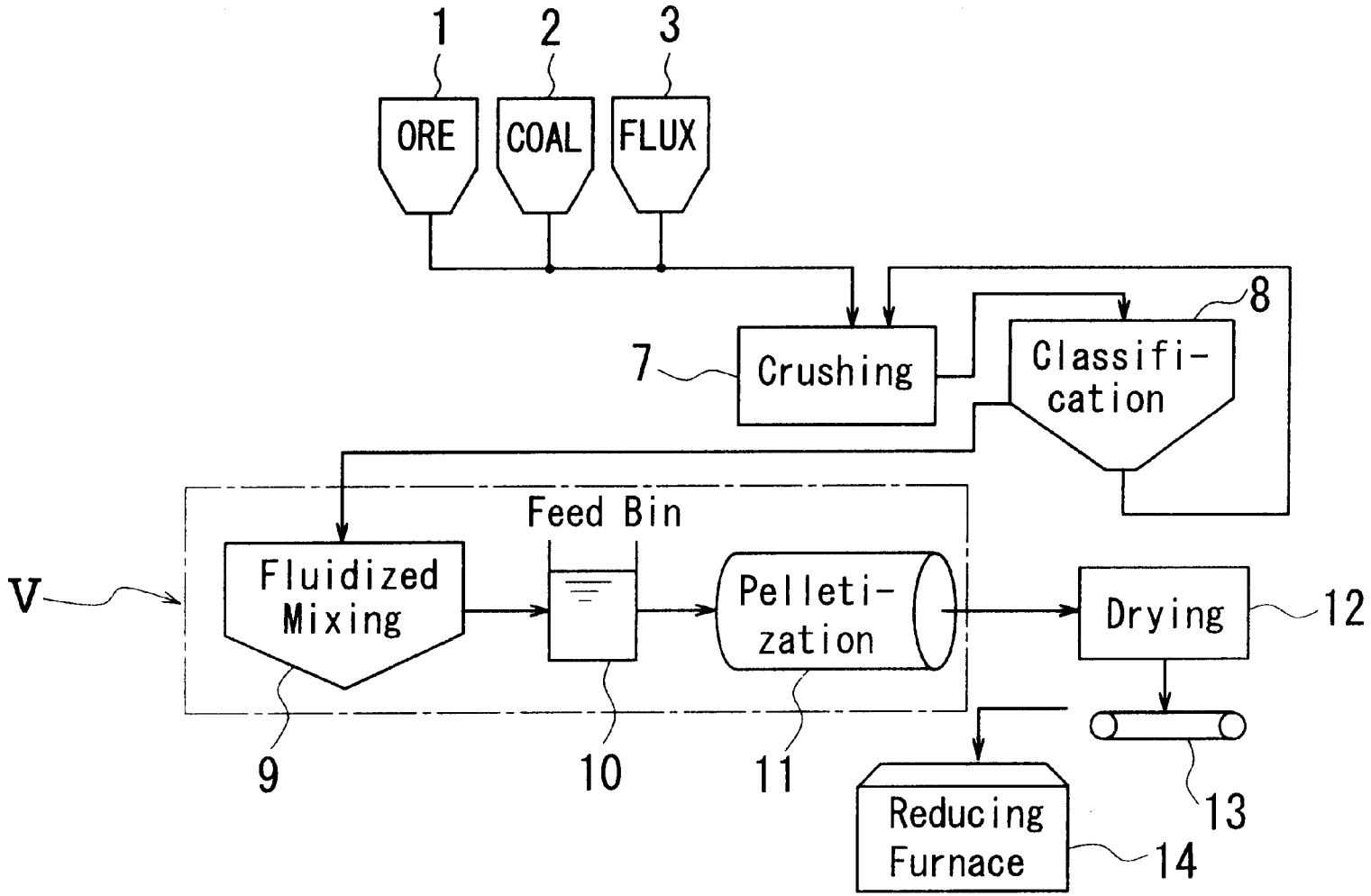
FIG. 4 is a concept view of a pretreatment apparatus for raw materials for production of reduced iron according to a second embodiment of the present invention.
Figure 5:
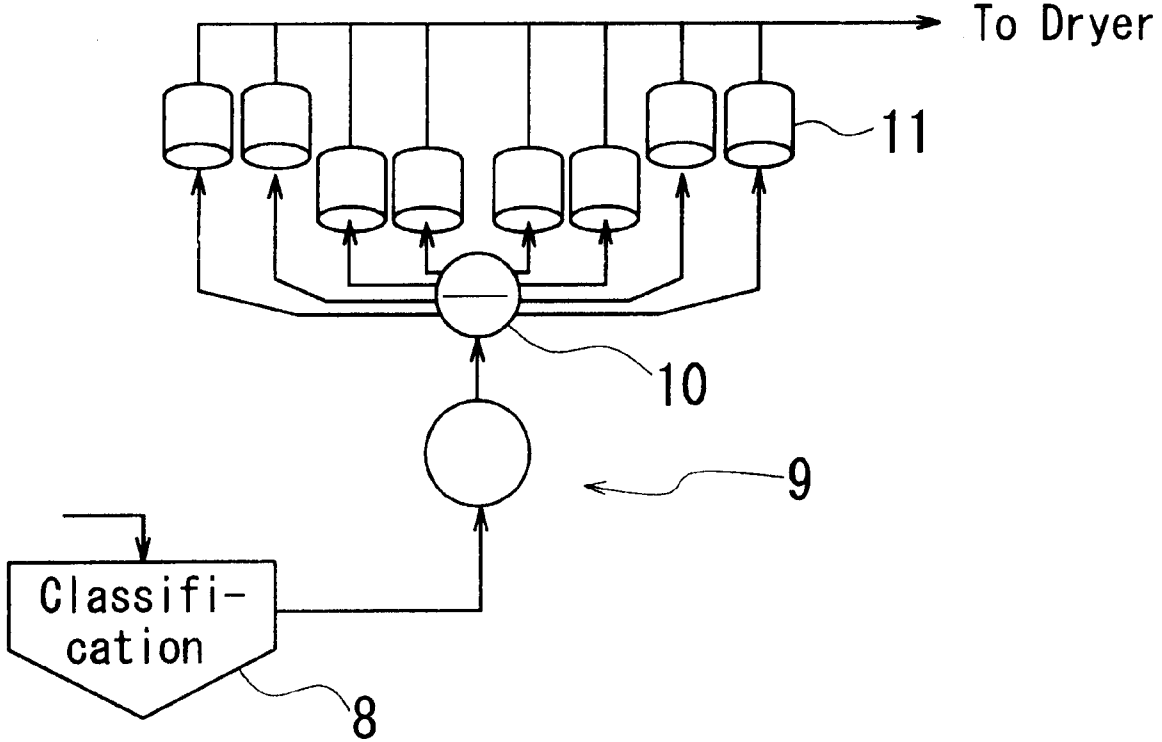
FIG. 5 is a facility configuration view of a portion V in FIG. 4.
Figure 6:
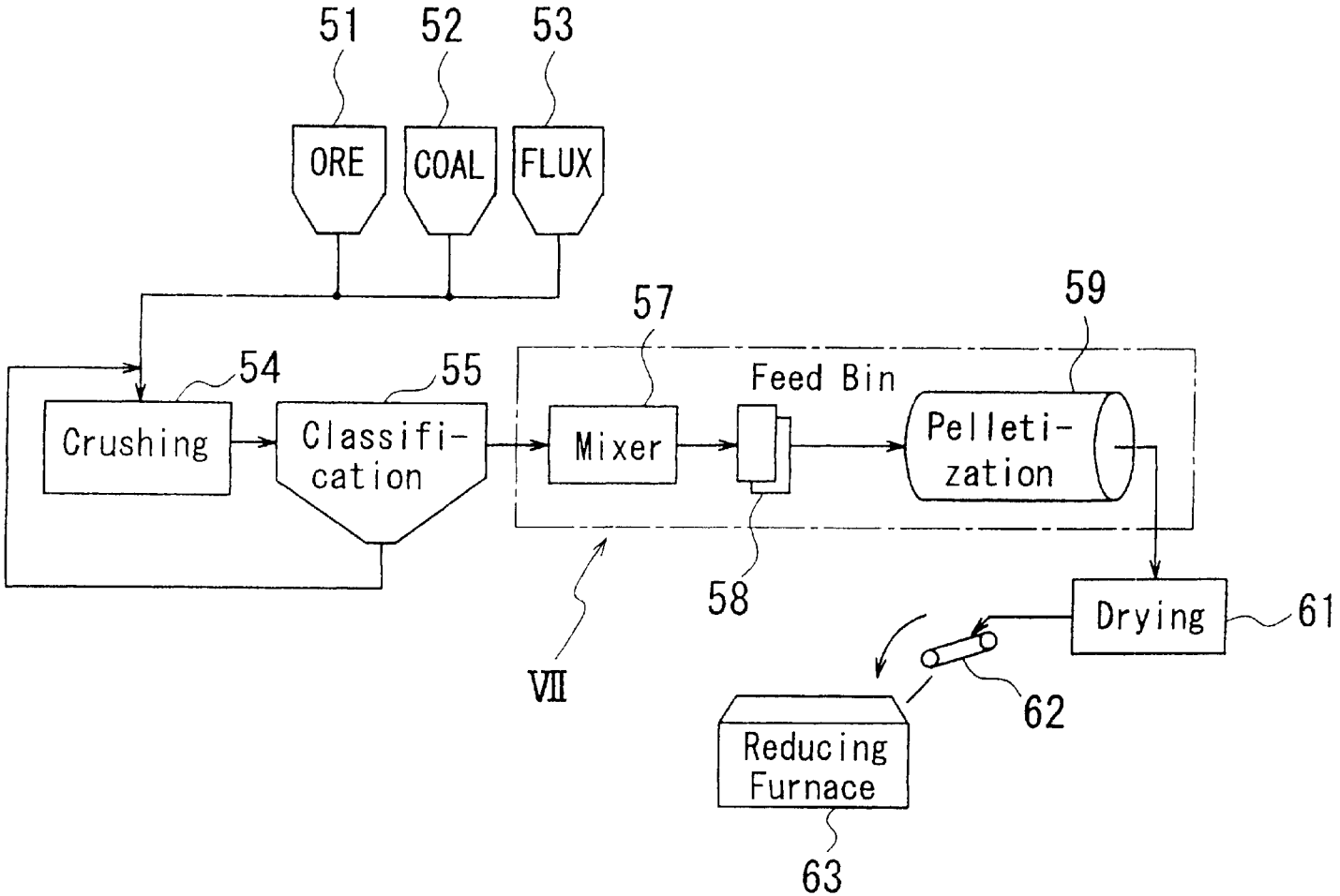
Fig. 6 PRIOR ART
FIG. 6 is a concept view of a conventional pretreatment apparatus for raw materials for production of reduced iron.
Figure 7:
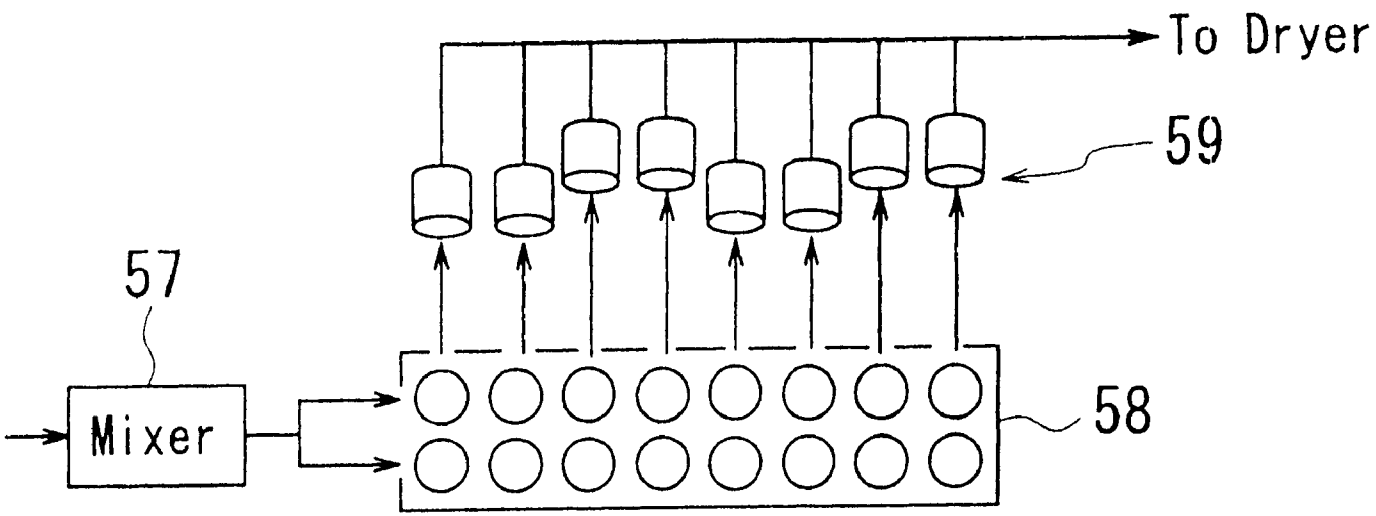
Fig. 7 PRIOR ART
FIG. 7 is a facility configuration view of a portion VII in FIG. 6.

FIG. 4 is a concept view of a pretreatment apparatus for raw materials for production of reduced iron according to a second embodiment of the present invention. FIG. 5 is a facility configuration view of a portion V in FIG. 4.

According to the present embodiment, as shown in FIG. 4, when the iron ore in the raw material silo 1 in the First Embodiment has a predetermined or smaller particle size, thus requiring no crushing by a crusher, and contains moisture, the iron ore is supplied to the vertical mill 7 without being passed through the dryer 4, classifier 5 and roll press 6 in the First Embodiment. Thus, the iron ore is dried and crushed together with the coal and flux supplied from the raw material silos 2 and 3. In other words, the present embodiment makes effective use of a drying function inherent in the vertical mill 7, without increasing the capacity of the mill. In the present embodiment, moreover, before the mixed powders after crushing and classification enter the fluidized mixer 9 as shown in FIG. 5, the mixed powders are premixed in the vertical mill 7. Thus, there is no need for batch treatment using a plurality of the fluidized mixers 9 as in the First Embodiment. The mixed powders transported from the classifier 8 are mixed by a single fluidized mixer 9, and continuously supplied, as such, to a feed bin 10. Other features are the same as in the First Embodiment, and duplicate explanations are omitted, with the same members as in the First Embodiment being assigned the same numerals.

According to the present embodiment, the dryer 4, classifier 5 and roll press 6 in the First Embodiment are unnecessary, and only one fluidized mixer 9 suffices, so that the equipment cost can be markedly decreased. Other actions and effects are the same as in the First Embodiment.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pretreatment apparatus for raw materials for production of reduced iron, which applies pretreatment steps, including drying, crushing, classification, and mixing, to the raw materials for production of reduced iron, the raw materials comprising an iron material, consisting essentially of iron ore, and other raw materials comprising coal and flux, comprising:

a pelletization device;

a feed bin feeding the pretreated raw materials to said pelletization device; and a fluidized mixer for mixing the raw materials for production of reduced iron after the classification.

2. The pretreatment apparatus for raw materials for production of reduced iron as claimed in claim 1, further comprising at least two of the fluidized mixers provided for batch treatment, one of the fluidized mixers for storage and the other fluidized mixer for supply.

3. The pretreatment apparatus for raw materials for production of reduced iron as claimed in claim 2, wherein when the iron material such as iron ore exceeds predetermined particle size, the iron material is crushed by a dedicated crusher, and the other raw materials are both crushed by a separate single crusher.

4. The pretreatment apparatus for raw materials for production of reduced iron as claimed in claim 3, wherein the crusher for crushing the iron material crushes an unrecovered iron material classified by a classifier, and returns the crushed iron material to the classifier.

5. The pretreatment apparatus for raw materials for production of reduced iron as claimed in claim 1, wherein when the iron material has a predetermined or smaller particle size, the iron material is directly supplied from a raw material silo to a crusher for the other raw materials, and premixed with the other raw materials, and the fluidized mixer is provided alone for continuous treatment of the premixed raw materials.

6. The pretreatment apparatus for raw materials for production of reduced iron as claimed in claim 1, wherein the fluidized mixer comprises air nozzles, located at the bottom of the fluidized mixer, for releasing pressurized air into the iron ore and the other raw materials in order to maintain the iron ore and raw materials in a fluidized state for a predetermined period of time.

* * * * *